US006854234B2

(12) United States Patent
Gimpel et al.

(10) Patent No.: US 6,854,234 B2
(45) Date of Patent: Feb. 15, 2005

(54) PANEL CONNECTOR SYSTEM

(75) Inventors: Dixon Gimpel, Minneapolis, MN (US); Timothy Cota, Minneapolis, MN (US); William Funk, Eagan, MN (US)

(73) Assignee: Skyline Displays, Inc., Egan, MN (US)

( * ) Notice: Subject to any disclaimer, the term of this patent is extended or adjusted under 35 U.S.C. 154(b) by 33 days.

(21) Appl. No.: 10/182,547

(22) PCT Filed: Feb. 2, 2001

(86) PCT No.: PCT/US01/03386

§ 371 (c)(1),
(2), (4) Date: Dec. 18, 2002

(87) PCT Pub. No.: WO01/57332

PCT Pub. Date: Aug. 9, 2001

(65) Prior Publication Data

US 2004/0123548 A1 Jul. 1, 2004

(51) Int. Cl.[7] ..... E04B 2/00

(52) U.S. Cl. ..... 52/586.2; 52/587.1; 52/239; 160/135; 40/506; 403/339

(58) Field of Search ..... 52/578, 582.1, 52/586.2, 587.1, 239, 282.1, 220.7, 792.1, 586.1, 282.5; 160/135, 351; 403/339; 40/605–606

(56) References Cited

U.S. PATENT DOCUMENTS

| | | | |
|---|---|---|---|
| 4,967,531 | A | 11/1990 | Giles et al. |
| 5,179,810 | A | 1/1993 | Gename et al. |
| 5,295,341 | A | 3/1994 | Kajiwara |
| RE34,738 | E | 9/1994 | Brady |
| 5,412,918 | A | 5/1995 | Wendel et al. |
| 5,546,720 | A | 8/1996 | LaBruzza |
| 5,857,304 | A | 1/1999 | Karten et al. |
| 5,970,675 | A | 10/1999 | Schray |

OTHER PUBLICATIONS

International Search Report for PCT/US01/03386.
Written Opinion for PCT/US01/03386.

*Primary Examiner*—Winnie Yip
(74) *Attorney, Agent, or Firm*—Patterson, Thuente, Skaar & Christensen, P.A.

(57) ABSTRACT

A panel connector system is provided and includes a plurality of panels and panel connectors. Each panel includes panel sidewall extensions, lips extending from the sidewall extensions, and cross-walls. The sidewall extensions, lips, and cross-walls define outwardly opening edge channels. The panel connectors include a base and a member extending generally transversely from the base. The base includes a base plate and a contact element. The arm portion includes a generally longitudinal slot, a ledge or protruding portion and a spring portion. A male seating surface extends from the ledge and a female seating surface is present on the spring portion. The clip base plate is fastened to the panel cross-wall and one of the lips is disposed in the clip slot when the clip is attached within the edge channel. Two panels are reversibly connected by raising one of the panels and vertically aligning and lowering one of the edges of the raised panel with one of the edges of the other panel, thereby slidably and vertically mating the fastened connectors. When the connectors are mated, the biasing elements are slidingly resiliently biased toward the connector ledges, the male seating surfaces is disposed on the female seating surface, and adjacent lips of joined panels are disposed in the connector slot.

21 Claims, 6 Drawing Sheets

PANEL CONNECTOR SYSTEM

BACKGROUND OF THE INVENTION

1. Field of the Invention

The present invention relates generally to display panels and, in particular, the present invention relates to devices for connecting display panels.

2. Background of the Invention

Display panel systems are widely used in reception areas, trade shows, museums, art exhibits, academic and research society meetings, and the like where displays or visual information is temporarily displayed or where physical space barriers are desired. The faces of these panels may be rigid or may incorporate soft materials (e.g., cork) or magnetic materials for temporarily attaching the visual information to the panels. It is desirable that panel systems may be quickly and easily assembled and disassembled to accommodate a variety of display sizes and configurations, for storage, and for transportation to another site. It is also desirable that these display panels be securely connected so that the panels do not separate during use and so that they form a stable structure. It is further desireable that such panels are "full-bleed" panels where the panel connectors and/or framework intermediate panels are not exposed and the decorative or informational surfaces extend over the entire visual surface.

U.S. Pat. No. 5,546,720, issued Aug. 20, 1996 to LaBruzza, discloses a panel assembly system in which adjacent panels are removably joined at their edges and includes the panels and substantially identical clips for joining the panels. The panel edges define a channel with flat walls extending parallel to their respective panel from a channel bottom to the panel edge. The panels are joined by the clips. Each clip includes a base portion and a body portion. The clip body portion extends upwardly from the base portion in a generally perpendicular disposition with respect to the base portion. At least two linear members extend parallel to the base along the body portion. These linear members define slots which also extend parallel to the base. The clip body portion further includes a substantially flat, outwardly facing portion opposite the linear members. The base of each clip is designed to be affixed to the channel bottom. When the clip base is mounted in place, at least one of the linear members and at least one of the slots is disposed within the channel and at least one of the linear members and at least one of the slots extend out of the channel beyond the panel edge. The flat outwardly facing portion of the body of each clip extends in substantial contact with its adjacent channel wall when the clip is affixed in the channel. The clips and their associated panels can be mounted to one another by sliding the linear members of one of the clips into complementary slots in the other clips with the channel walls preventing the two clips from being disengaged. To disassemble the panels, they are vertically slid apart.

The engaging surfaces of the cooperating LaBruzza connectors are at an angle offset from vertical at approximately 45°. This results in one force component that urge the cooperating panel connectors and their connectors together and a second force component acting to push the flat walls of the channel outwardly. To the extent that two adjoined panels are urged apart, the principal members resisting the separation are the channel walls. This can result in deformation and damage to the channel walls. Once such damage occurs the connection is compromised visually in that a gap may be visible, and also compromised form a structural perspective, that is, the connection may be loose and insecure.

While the LaBruzza clips reversibly connect display panels, these clips depend on the rigid channel walls to remain connected. Thus, it would be advantageous to provide panel connectors with features retaining the connectors in a mated position substantially independent of the rigidity of the channel walls and where the tolerances and sizing were not as critical. It would also be advantageous to provide channel connectors with features which would seat when the connected panels and connectors were vertically aligned. It would also be advantageous to provide a display panel system that utilizes resilience in the connectors to secure the panels together U.S. Pat. No. 3,777,435, issued Dec. 11, 1973 to Perina, discloses an attachment assembly for releasably joining panels or partitions along their edges. The attachment assembly includes two channel members, each channel member secured along the edge portions of the panels to be joined. Separable fastening members are secured in each channel member in a manner permitting the fastening members to slide along each channel member. The panels or partitions are secured together by engaging the fastening members of each channel member.

U.S. Pat. No. 4,462,196, issued Jul. 31, 1984 to Freiberg, discloses means for interconnecting panels including a flanged member adapted to be secured to, or formed integral with, the vertical edges of each panel. Each flanged member is provided with one or more flanges which mate with corresponding flanges of the flanged member of an adjacent panel to prevent separation of the adjacent. Each flanged member is provided with an open longitudinal channel. The open longitudinal channel is disposed on the flanged member on the adjacent panel to define a closed channel when in a mating position. Each flanged member also includes a locking strip adapted for engagement in the closed channel to prevent separation of the flanged members in a direction substantially at right angles to the line of the panels.

U.S. Pat. No. 4,610,560, issued Sep. 9, 1986 to Miller, discloses a panel display connector. The connector allows adjoining panels of a display device to be joined to each other and be moved in pivotal relationship with each other. The connector includes a male member and a connector plate. The male member is secured to an integral channel of the displayed device. The connector plate joins two or more channels together. When the channels are joined using the connector of this invention, the channels and their associated display panels may be pivotally disposed in relationship to each other.

U.S. Pat. No. 4,712,336, issued Dec. 15, 1987 to Backer, discloses an interconnecting "full bleed" modular panel and connective hardware system to form a variety of exhibit and office interior enclosures. The modular "full bleed" panel system includes interchangeable, interconnecting elements for creating display booths, room divides and the like. The system includes a series of modular panels of different shape, construction, and function, together with a series of modular connector elements adapted to interconnect each of the panels to form a variety of stable structures presenting a visually unitary appearance and in which the connector elements are not significantly visible.

U.S. Pat. No. 5,092,385, issued Mar. 3, 1992 to Beaulieu and assigned to the assignee of the present invention, discloses an interlocking panel system including individual, thin-walled sections. Each section is supported by a rectangular frame formed from an edge strip material. Each edge strip is constructed with an outwardly facing interlocking channel to permit interlocking engagement of hinges and other connectors. The system further includes a flexible hinge assembly and locking levers. The hinge assembly has outer edges shaped to slidably engage into the edge strips. The locking levers index and affix the respective flexible hinges in a locked relationship to the panel sections. The edge strips have selectively positioned holes and a slidable bar. The slidable bar is movable into position along the edge strips to permit the attachment of locating pins and feet for the various panel sections.

U.S. Pat. No. 5,097,643, issued Mar. 24, 1992 to Wittier, discloses interlocking structural members with edge connectors. The edge connectors connect structural members at adjacent edges. Each edge connector includes a base, a support wall, and a tongue. The base extends transversely between its edges. The Support wall is integral with the base and extends away from the base on one side. The support wall further extends generally parallel to the base edges and is positioned between the transverse center of the base and one edge thereof. The tongue is integrally connected at one end to the support wall and extends from the support wall to a free end. The tongue is further spaced away from the base and positioned between the transverse center of the base and the other edge of the base on the side of the center opposite the one base edge. The tongue and the base define a recess therebetween to receive the tongue of a mating connector. The Wittier system does not provide for panel faces of adjacent panels that directly adjoin to provide a substantially continuous facing.

U.S. Pat. No. Re. 34,738, reissued Sep. 27, 1994 to Brady, discloses a concealed portable display device fastener, which includes a channel interlocking means and a flexible clip. The channel interlocking means projects outwardly at one end and includes a barb web attachment means at an opposite end. The flexible clip has a plurality of semicircular open edge tubes joined perpendicularly to a rectangular plate interlocking means. When interlocked, these components form a single fastener conjointly matable with another fastener by a horizontal, then vertical movement of clips through interlocking means for assembly and disassembly.

U.S. Pat. No. 5,642,557, issued Jul. 1, 1997 to Clews, discloses a panel display system relating to a clip for releasably connecting a panel edge to a rod. The clip includes a first jaw for releasable connection to the panel edge and an opposed, substantially arcuate second jaw for releasable connection to the rod. The first jaw includes a locking means for engaging a complementary part of the panel edge. The first and second jaws are integrally formed of a resilient material. The clip joins display panels together about a common connecting rod. Once connected or joined, the display panels are free to move with respect to each other about the common connecting rod, which acts as a hinge. This system does not allow adjacent panels to directly adjoin one another to form a continuous facing.

U.S. Pat. No. 5,857,304, issued Jan. 12, 1999 to Karten et al., discloses a slidable locking system for disengagable panels. The system connects a first panel to a second panel in a manner aligning the first and second panels at the same vertical level. The first panel has a female connecting member along its vertical edge and a channel disposed transverse to the vertical edge. The second panel has a male connecting member provided along its vertical edge and a slot provided in the male connecting member. A sliding pin block is retained for sliding movement inside the channel of the first panel. The sliding pin block has a pin normally biased to extend through the female connecting member. The pin is fitted inside the slot of the male connecting member where the first and second panels are interconnected along their vertical edges. This system has several moving parts and generally requires metal components and assembly time. Such increases the cost of such systems compared to injection molded plastic connectors. Moreover, this system does not have a resiliency feature to urge the adjoined adjacent panels together.

U.S. Pat. No. 5,970,675, issued Oct. 26, 1999 to Schray, discloses a modular panel assembly. The modular panel assembly includes a connector which attaches panel elements to assemble modular structures. The connector frictionally engages the surfaces of elongated channels at the edge of the panels to be joined. The connector includes a contoured base section complementary with the channel of a first panel, to which the connector can be optionally screwed. A deformable cam section is carried on an intermediate section for receipt in the channel of the second panel. The cam section preferably has opposite cantilever arms which engage flanges of the anchor channels and the arms are tapered to deform inwardly of the channel for friction and inwardly from the joint so as to draw the panels together. The above patents are all hereby incorporated by reference.

None of these display panel systems have connectors fixed to the panels which may be reversibly connected and which provide resiliency to urge the panels together to facilitate a continuous full bleed panel facing and which function without relying on the rigidity of the channel wall at the edges of the panels.

SUMMARY OF THE INVENTION

The present panel system meets the aforementioned needs of the industry by providing panels and connectors which enable the panels to be easily assembled and disassembled to provide a continuous "full-bleed" panelar facing suitable for displaying visual information, decoration, or for providing space separation. The panels can be assembled into any desired configuration and dimension and are easily disassembled for storage or transportation. In preferred embodiments, each panel include a pair of (first and second) sidewalls and a cross-wall extending between the sidewalls. The sidewalls extend beyond the cross-wall, each sidewall extension terminating in a lip. The sidewall extensions, lips, and cross-wall form an edge channel at lateral edges of the panel.

The connectors are used to join with minimal gaps or cracks at the panel junctures. One preferred embodiment of the present connector includes a base and a member extending generally transversely from the base. The base includes a base plate and a contact element. The base plate mounts to the panel cross-wall using connectors such as a pair of bolts. The arm portion defines a generally axial slot, an axial ledge, and a resilient biasing element or spring portion extending from the ledge. A male seating surface extends from a central location of the biasing element and a female seating surface is present on a central location of the biasing element. The male and female seating surfaces are located so as to mate when a pair of connectors is slidably joined during panel assembly. When the connector is mounted in the panel edge channel, one of the lips is disposed in an inboard portion of the slot.

When the panels are being reversibly joined, one of the panels is raised such that the connectors are vertically aligned and such that an inboard surface of each biasing element will slidingly contact an outboard surface of the base contact element of the other connector. The raised panel is then lowered, displacing a portion of the biasing element of each connector toward its corresponding ledge. When the panels are vertically aligned, the male seating surface of one connector will be seated in the female seating surface of the other connector and both adjacent lips of adjoined panels will be disposed in the same connector slot.

One feature of this invention is that, when a pair of the present connectors are installed within edge channels portions of panels to be reversibly connected, the joined connectors are held together by the rigid panel cross-walls and sidewall extensions, by the biased biasing elements, by the mated seating surfaces present on the connectors, and by adjacent lips of connected panels disposed in the same connector slot.

Another feature of this invention is that the present connector is easily and inexpensively manufactured by known methods.

Another feature and advantage of the invention is that the cooperating seating surfaces of the connectors that provide the forces to secure the abutted panels together are normal to the planes of the panels thereby minimizing lateral stresses on sidewalls of the channel portions.

Another feature and advantage of the invention is that apertures or cutaway portions are utilized to create plastic spring members that provide bias to urge cooperating connectors and the attached panels together.

Yet another feature of this invention is that the present panel system may be set up and taken down without the use of tools.

Still another feature of this invention is that the present connector may be easily and quickly replaced in the edge channels by using simply and widely available tools, e.g., screwdrivers and pliers.

Still yet another feature of this invention is that the present connectors are totally enclosed within the channels of connected panels, thereby eliminating any spaces or gaps therebetween providing a full-bleed display.

Yet still another feature of this invention is that the symmetrical design of the present connector allows either panel to be raised and lowered into place when a pair of panels is being reversibly joined.

These and other advantages will become apparent as this invention is more fully described hereinbelow.

DETAILED DESCRIPTION OF PREFERRED EMBODIMENTS

Figure 1:
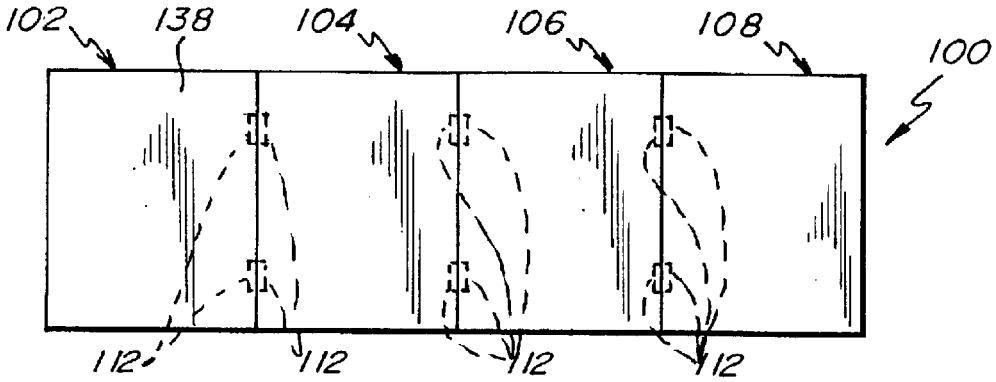
FIG. 1 is a front view of one embodiment of the panel system of this invention showing exemplary locations of the connectors of this invention installed thereon.
Figure 2:
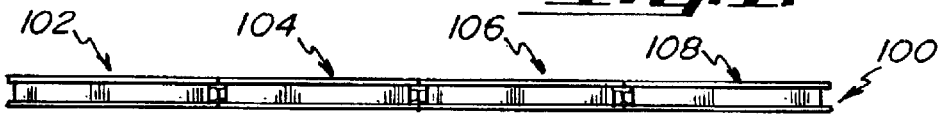
FIG. 2 is a plan view of the panel system of FIG. 1.
Figure 3:
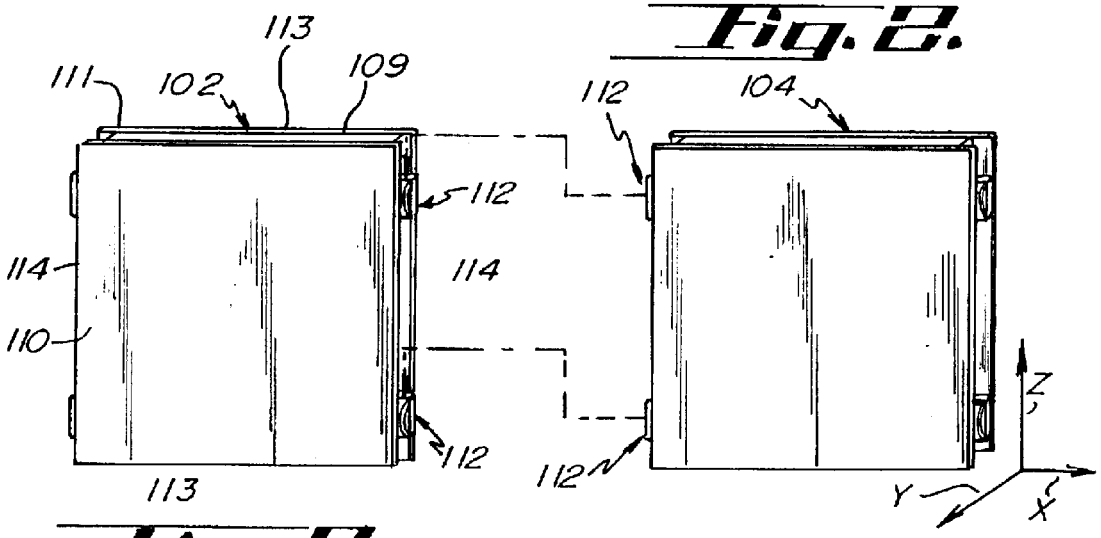
FIG. 3 is a front view of the present connectors installed on two of the panels of FIG. 1, arrows in phantom depicting how to reversibly connect the panels using the connectors.

Referring to FIGS. 1, 2, and 3, an exemplary panel system of this invention is depicted generally by the numeral 100 and includes a plurality of panels 102, 104, 106, and 108. These panels are connected by a connector designated by the numeral 112. Referring to FIG. 3, for assembly, the panel edges are abutted and aligned in the x and y axis with an offset in the z direction. The panels are then aligned in the z direction to engage the cooperating connectors 112. Each panel has a peripheral edge 109, a first panelar side 110, and second panelar side 111, two horizontal edges 113, and a pair of vertical edges 114.

Referring to FIGS. 4, 5, 6, 7, and 8. the panels 102 and 104 include first and second wall elements 116 and 118 and a cross-wall element 120. The first and second wall elements 116 and 118 are preferably unitary with the cross-wall 120 and form an edge channel 136. Extensions of the wall elements 116, 118 are positioned outboard the cross-wall 120, form the channel side walls designated as 122 and 124, respectively, and have inwardly pointing ups 126 and 128. The channel side walls and display respective inner surfaces 130 and 132 and the cross-wall or channel base 120 has outboard surface 134. Directionally, inboard and outboard are considered to indicate toward and away from a panel center. The edge channel has an axis $\alpha$ extending circumferentially around each panel in the channel. "Axial" when used herein indicates parallel to the axis $\alpha$. "Lateral" means a direction transverse to the axis toward the channel sidewalls. The inner surfaces 130 and 132 and the outboard surface 134 define an edge channel cavity 137. Channel portion 136 opens to the outside between the lips 126 and 128.

The wall elements may extend across the panelar sides of the panels or may provide a framework for the panel. In such a case the wall elements may be H-shaped and utilize a foam interior and laminate extending over the wall elements and encasing the foam interior. The laminate forms the display surface 138. Exemplary details of construction of panels are disclosed in the following applications also assigned to the assignee of this application:

U.S. Patent Application for PANEL DISPLAY SYSTEM WITH WIRE MANAGEMENT application Ser. No. 09/556,381; Filed Apr. 24, 2000

U.S. Patent Application for PANEL DISPLAY SYSTEM application Ser. No. 09/556,382; Filed Apr. 24, 2000

These two applications are incorporated herein by reference.

The panels of this invention may be reversibly interconnected by using the connector 112 operably disposed within the channel 136. The present connector may be formed by injection molding polycarbonate or other suitable materials.

Additives, such as polytetrafluoroethylene may be added to the polycarbonate to lower the plastic to plastic resistance and make the assembly of panels easier. Other plastics, for example, acetals, acrylics, polyethylenes, fluoropolymers, and other thermoplastics may also be suitable. The connector 112 is unitary in this embodiment, preferably injected molded, and includes base member 150 and grasping arm portion 152 configured as an upright elongate projection. The base member 150 includes plate 156 and contact element 158. Plate 156 displays inboard and outboard surfaces 160 and 162 and the contact element 158 displays outboard surface 164. One or more bolt holes 166 may be present in the plate 156. The arm portion 152 displays respective first and second surfaces 168 and 169 and may be considered to include an arm extension portion 170, a resilient biasing element configured as an arcuate spring element 172 with an arcuate slot 173 and a generally axially extending with respect to the channel portion axial ledge 174. The arcuate spring portion has two ends 175 and that are integrally connected with the arm portion 152 at said ends. A generally axial slot 176 is defined proximate second surface 169 and extends generally parallel to the base plate 156 along the transverse extension 170 in this embodiment. A plurality of ribs 178 may be defined in transverse extension 170. These ribs may extend generally perpendicularly, or otherwise transversely, from the base plate 156. The spring portion 172 is disposed proximate first surface 168 of arm portion 152. Both lateral ends of the spring portion may extend from the laterally and axially extending cantilever portion configured as a ledge 174. Said cantilever portion is configured as a protruding portion with respect to the arm portion. A gap 180 is defined between central portions of the biasing element 172 and the ledge 174. A seating surface, such as a notch 182, is generally centrally defined proximate an inboard surface 184 of the biasing element 172. The ledge 174 displays respective inboard and outboard surfaces 184 and 186 and has a seating surface, such as on projection 188, extending from the inboard surface 184. The present seating surfaces are disposed such that extensions 188 will simultaneously seat in notches 182 of two connectors 112 being mated when adjoining panels are vertically aligned. Of course, the positions of these seating surfaces could be reversed. Moreover, these seating surfaces may be located at other sites on the present connector (see below). A seating surface pair is considered to encompass complementary surfaces in which a first surface at least partially conforms or accommodates a second surface and function secures the connectors and thus the panel together.

Note that in the preferred embodiments, the cooperative seating surfaces are oriented substantially normal to the plane of the panels, that is the panel plane is the z-x plane, and the surfaces are normal to the z-y plane and extend substantially in the "y" direction.

Figure 6:
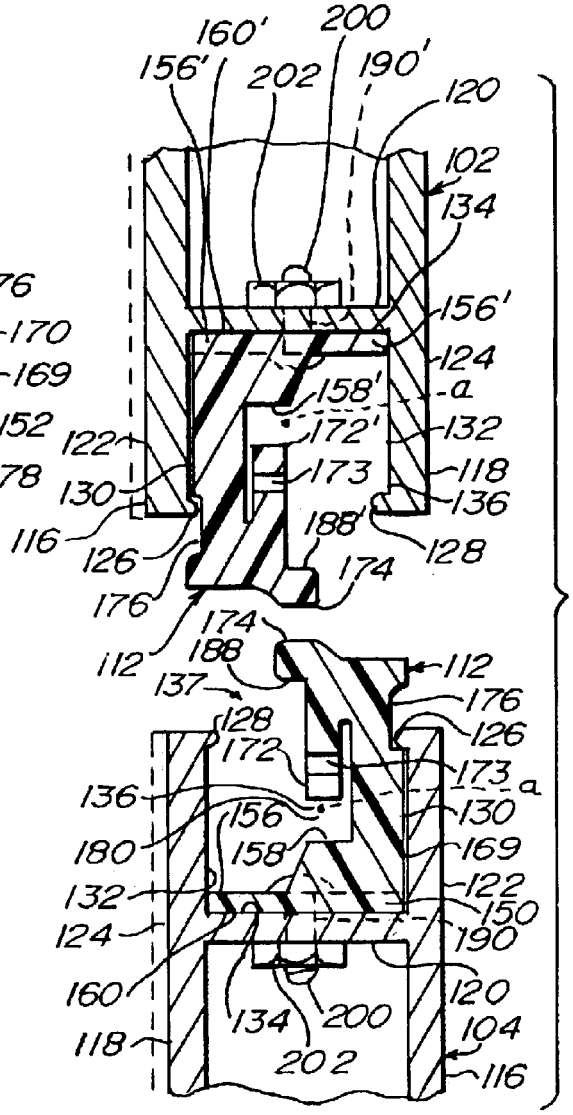
FIG. 6 a vertical cross section of the panels of FIG. 2, depicting two of the connectors of FIG. 4 installed thereon.
Figure 7:
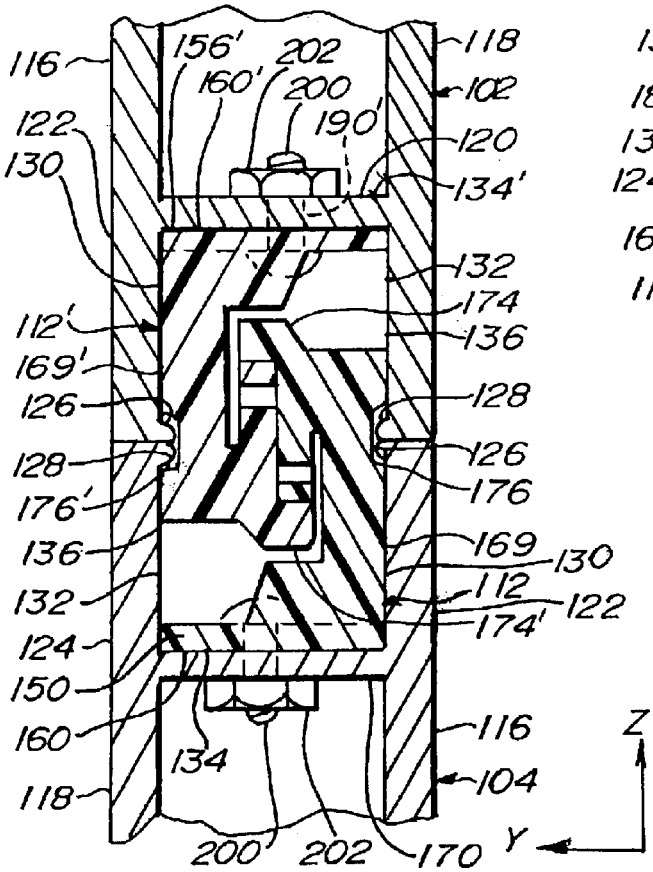
FIG. 7 is the cross section of FIG. 6, in which the panels have been reversibly connected by slidingly mating two of the connectors of FIG. 4.
Figure 10:
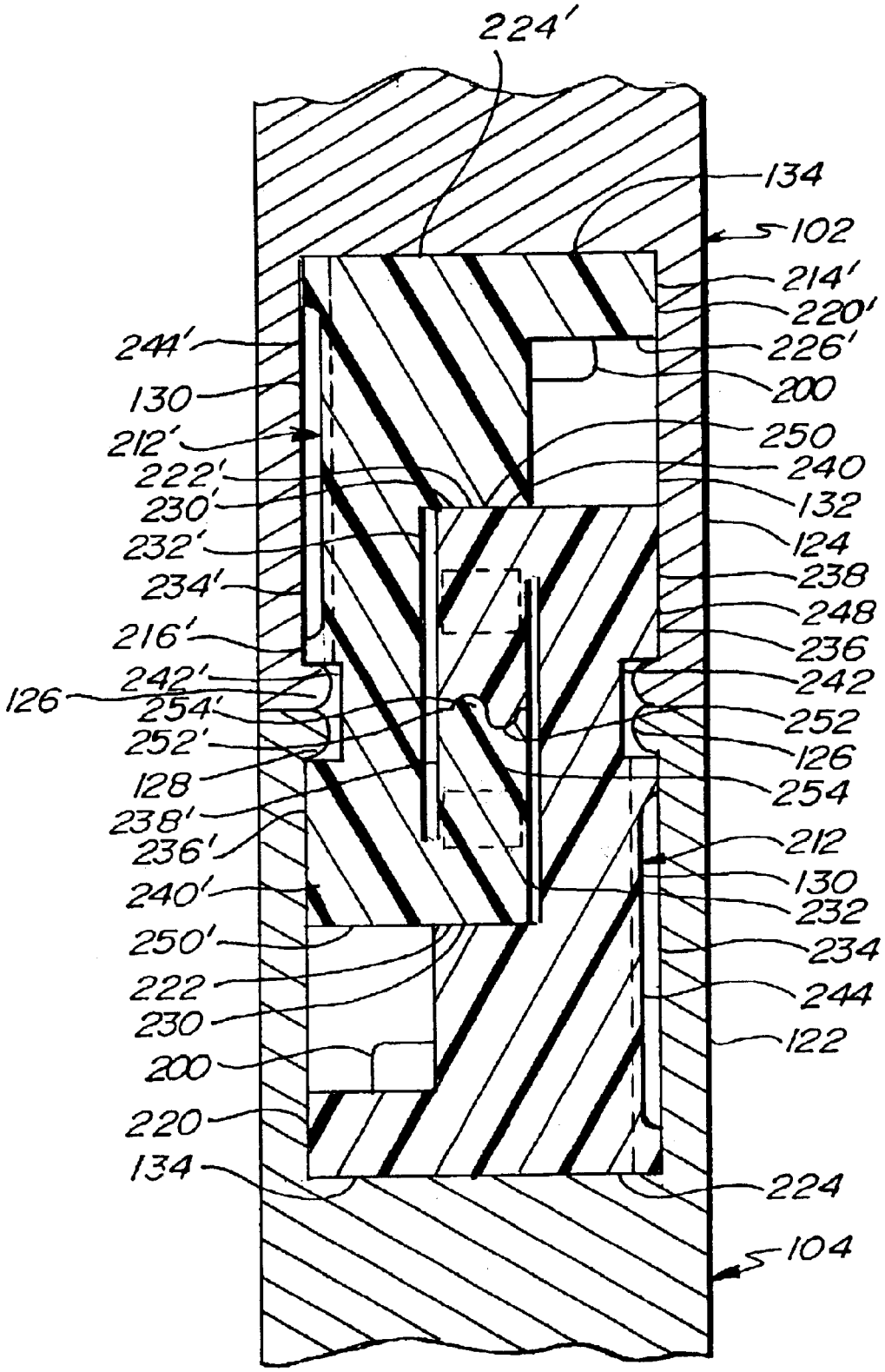
FIG. 10 is a vertical cross section of the panels of FIG. 2 reversibly connected by two of the connectors of FIG. 9.

Referring to FIGS. 1 and 6, two or more of the present connectors are installed within each lateral channel portion 136 of a panel and positioned therein such that the panels will align vertically when the connectors are reversibly mated. In FIGS. 6, 7, and 10, the connector and connector elements mounted to panel 102 are designated with single primes (') for better clarity. The inboard surface 160 of plate 156 is disposed against the outboard surface 134 of cross-wall 120 and secured in position by extending a bolt 200 through each bore 166 and a pre-drilled hole 190 in cross-wall 120, and securing the bolt 200 in place with a nut 202. When secured in this position, the second surface 169 of arm portion 152 will contact inner surface 130 of wall extension 122 and the lip 126 will extend into the gap 176.

Figure 4:
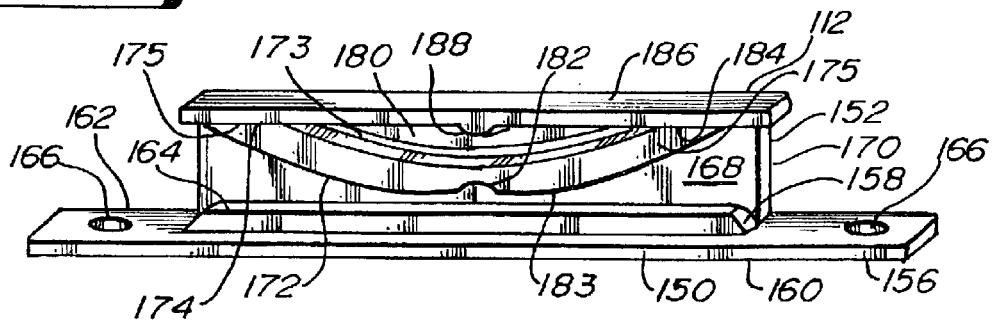
FIG. 4 is an end view of a first embodiment of the connector of this invention.
Figure 5:
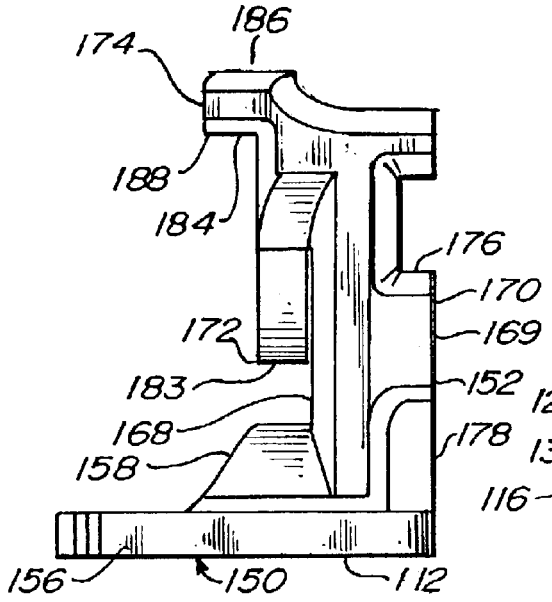
FIG. 5 is a side view of the connector of FIG. 4.
Figure 8:
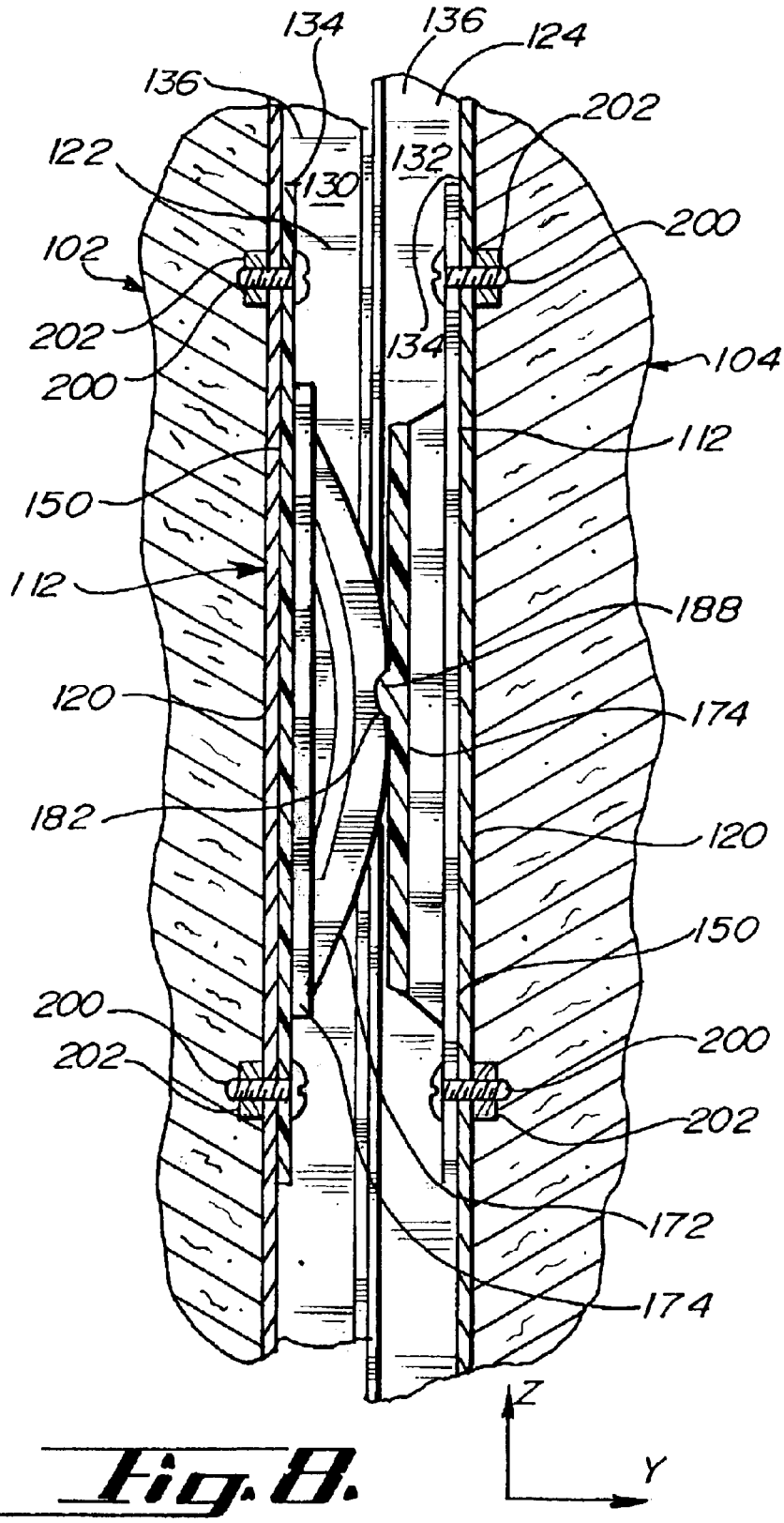
FIG. 8 a side cross section of the panels of FIG. 2 reversibly connected by two of the connectors of FIG. 4.

As seen in FIG. 3, the panels 102 and 104 are connected by lifting panel 104, the slidably mating adjoining connectors 112 by lowering the panel 104. FIGS. 4, 5, and 6 depict the features and surfaces involved in mating adjoining connectors 112. FIGS. 7 and 8 cross-sectionally show mated connectors of the present invention. When the present connectors are installed in a panel channel as described above, and adjoining panels 102 and 104 are to be mated, FIG. 6 depicts the relationship of connectors 112 to be mated. The panel 104 may be raised and maneuvered such that the ledge 174 of each connector is vertically aligned to be inserted between the contact element 158 and the biasing element 172. Once thusly aligned, the panel 104 is lowered to force the ledge 174 between contact element 158 and biasing element 172. When the ledge 174 is being inserted therein, the portion of biasing element 172 proximate the notch 182 is slightly displaced within the gap 180. The panel 104 is further lowered until the extensions 188 of ledges 174 simultaneously seat in notches 182 of biasing elements 172. At this point, the panels 102 and 104 are reversibly secured. As can be seen from FIG. 7, when the present connectors are reversibly mated, the other lip 128 will also extend into the cavity 176, thereby further securing the panels 102 and 104 together and eliminating any gap between the panels 102 and 104. Moreover, when the present connectors are mated, they are totally enclosed with and braced against the wall extensions 122 and 124. While the procedure for making adjoining panels has been illustrated by raising, panel 104 the symmetrical construction of the present connector allows the opposite to occur as well Thus, panel 102 could be raised, aligned, and lowered to mate with panel 104. To disengage the adjoining panels 102 and 104, panel 104 (or panel 102) is raised until the ledges of the connectors are pulled free from between the biasing and contact elements.

Figure 9:
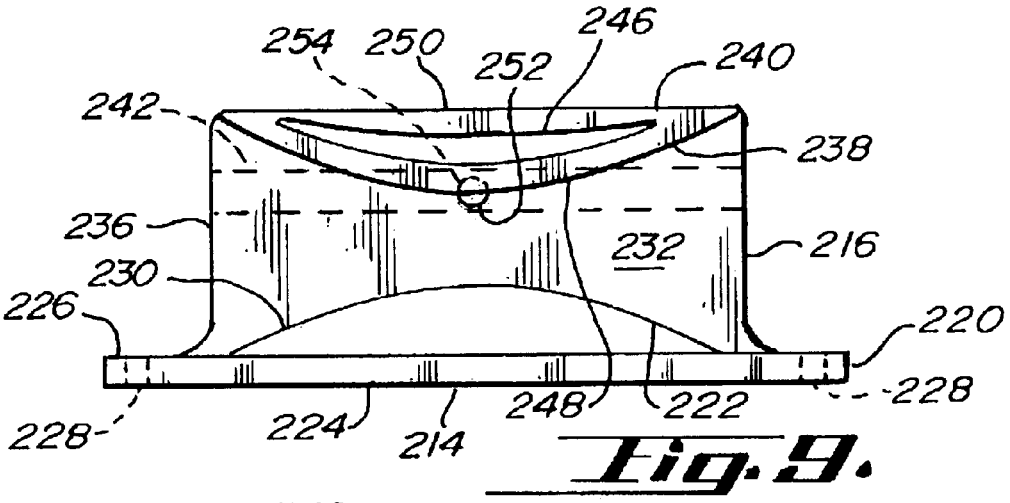
FIG. 9 is a side view of a second embodiment of the connector of this invention.

FIGS. 9 and 10 depict a second embodiment of the present connector, indicated generally by the numeral 212. The connector 212 is generally unitary in construction in this embodiment but may be considered to include respective base and arm portions 214 and 216. The base member 214, in turn, may be considered to include a plate 220 and an arcuate contact element 222. The plate 220 displays respective inboard and outboard surfaces 224 and 226 and may have a plurality of laterally disposed bolt holes 228. The contact element 222 arches or curves away from the base plate 220 in this embodiment and displays an outboard surface 230.

The arm portion 216 displays respective first and second surfaces 232 and 234 and may be considered to include a transverse extension 236, a biasing element 238, and an axial ledge 240. A generally longitudinal (axial) slot 242 and a plurality of ribs 244 are defined from second surface 234. The biasing element 238 extends arcuately from peripheral connection points to the ledge 240 and cooperates with a central portion of the ledge 240 to define a gap 246 therebetween. The biasing element 238 displays an inboard (contact) surface 248 and the ledge 240 displays an outboard (contact) surface 250. Seating surfaces, such as an extension 252 and a notch 254 are present side by side on a central location of the biasing element 238. The extension 252 extends from the inboard surface 248 and the notch 254 extends into the biasing element 238 from the inboard surface 248.

As best seen in FIG. 10, the connector 212 is installed in a channel 136 of one of the above-described panels by contacting inboard surface 224 of plate 220 to outboard surface 134 of cross-wall 120 and second surface 234 of arm portion 216 to inner surface 130 of wall extension 122. The connector 212 is then fixed in place by fasteners such as bolts 200 and nuts 202. When the connector 212 is fixed in this position, the lip 126 will extend into and occupy about one-half of the slot 242.

Continuing to refer to FIG. 10, the connector 212 is used to reversibly connect the present panels. In this case, panel 104 is raised and the connectors 2 12, which are attached to the panel 104 are vertically aligned with the connectors 212 attached the panel 102. In aligning the connectors 212, the outboard surface 250 of the ledge 240 is aligned to contact the outboard surface 230 of the contact element 222. The arcuate shape of the outboard surface 230 assists this vertical alignment. Simultaneously with aligning surfaces 250 and 230, the inboard surfaces 248 of the biasing elements will be aligned as well. The panel 104 is then lowered until extensions 252 are seated in notches 254. When the extensions 252 are seated in notches 254, the panels 104 and 102 are in vertical alignment after being reversibly connected. Obviously, the panel 102 could be raised and lowered to reversibly connect to the panel 104 because of the symmetrical configuration of the connector 212. To disconnect reversibly connected and adjacent panels 102 and 104, the panel 104 is raised until the connectors 212 are no longer interlocked.

Figure 11:
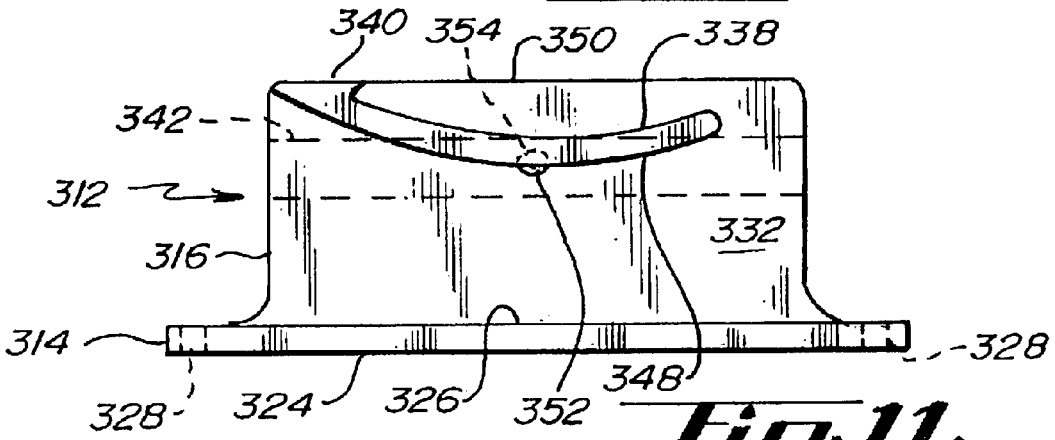
FIG. 11 is a side view of a third embodiment of the connector of this invention.

FIG. 11 depicts a third embodiment of the present connector by the numeral 312. Connector 312 is generally unitary in this embodiment, but may be considered to include a base member 314 and a arm portion 316. The base member 314 displays respective inboard and outboard surfaces 324 and 326 and defines a plurality of bolt holes 328. The arm portion 316 displays respective first and second surfaces 332 and 334 (not shown). A resilient biasing element 338 extends from a ledge 340 and a slot 342 is generally longitudinally defined and extends from the second surface 334 in this embodiment. In this embodiment, the ledge 340 extends only through a portion of the outboard surface 350. Also in this embodiment, only one end of the biasing element 338 is attached to the ledge 340. The other end of the biasing element 338 is unattached. The connector 312 also differs from the previous embodiments in that a contact element, such as contact elements 158 or 222, is absent.

The connector 312 is disposed in a panel channel such that the inboard surface 324 of the base member 314 is disposed against the outboard surface 134 of the cross-wall 120 and such that the second surface 334 is against the inner surface 130 of the wall extension 122 and secured in place by a connector such as the bolt 200 and nut 202. When thusly secured, the lip 126 will extend into and occupy about one-half of the slot 342. When reversibly connecting panels using the connectors 312 the panels are aligned such that inboard surfaces 348 of the connectors to be mated will contact. The panel 104 is then lowered until extensions 252 are seated in notches 354. At this point, the panels 102 and 104 should be generally vertically aligned and the lips 128 should contact the lips 126 and extend into the notch 354.

Figure 13:
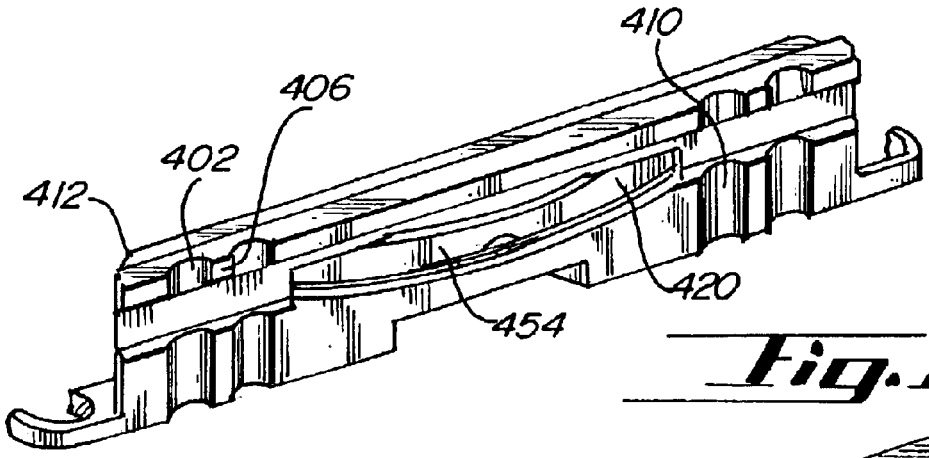
FIG. 13 is a rear perspective view of the connector of FIG. 12.
Figure 12:
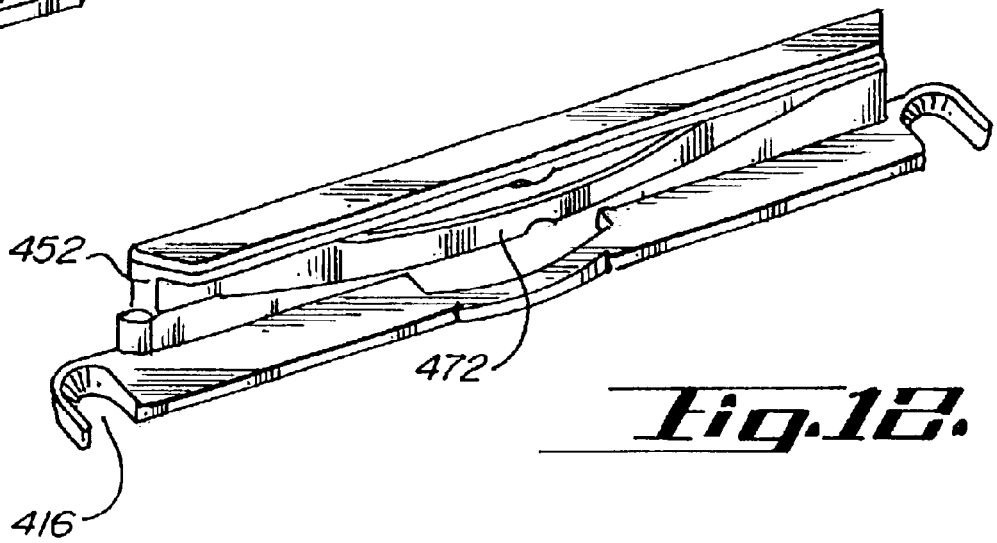
FIG. 12 is a front perspective view of an alternative connector in accordance with the invention.

Referring to FIGS. 12 and 13, a further embodiment of a connector is illustrated. This connector has several features that are believe to facilitate manufacture. Specifically the molding of the component. Notches 402 creating serrations 406 create a non planar surface on the back side 410 of the connector 412. This is believed to minimize warpage of the molded component during molding as well as providing stiffening structure for the component. The notches 416 are provided rather than screw holes facilitating easier molding. Also a cutaway portion configured as an arcuate aperture on the grasping arm portion 452 facilitates easier molding of the spring member 472 and provide biasing characteristics for the central arm portion 454.

Figure 15:
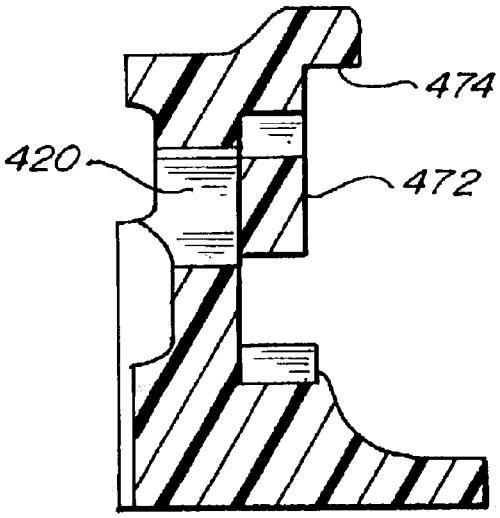
FIG. 15 is a cross-sectional view taken through the connector of FIG. 14.
Figure 14:
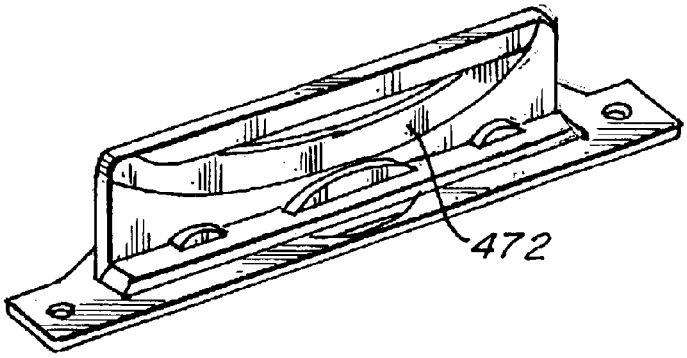
FIG. 14 is a perspective view of a further embodiment o a connector in accordance with the invention herein.

Referring to FIGS. 14 and 15, a further connector is illustrated. This connector has touch positioning portions 473 extending from the base member 450 to indicate by feel the correct positioning of the seating features on the cantilevered portion 474 and thus the proper positioning of cooperating connectors. Because numerous modifications of this invention may be made without departing from the spirit thereof, the scope of the invention is not to be limited to the embodiments illustrated and described. Rather the scope of the invention is to be determined by appended claims and their equivalents.

What is claimed is:

1. A first connector for reversibly attaching a first panel to a second panel, each panel including two side walls and a cross-wall, each side wall terminating in a lip, and the cross-wall cooperating with the side walls to define an edge channel, the first connector configured to be affixed in the first panel edge channel, a second substantially identical connector configured to be affixed in the second panel edge channel, the first connector defining a generally axial slot and comprising;

a base attachable to the first panel cross-wall.

a resilient biasing element and first and second seating surfaces in operative relation to the biasing element the first and second seating surfaces facing toward and spaced apart from the base, the biasing element extending from the first seating surface toward the base, the biasing element positioned to be biased away from said cross-wall when said first connector is present in said first panel edge channel, the first seating surface at least partially conforming to the second seating surface, the first and second panels reversibly attached by reversibly mating the first connector to the second connector by longitudinally aligning the first and second connector biasing elements, then displacing the first connector to bias the first and second connector biasing elements away from the cross-wall and until the first connector first seating surface is seated in the second connector second seating surface, the second connector first seating surface is seated in the first connector second seating surface, and adjacent lips of the first and second panels are disposed in the first and second connector slots.

2. The first connector of claim 1, further comprising an arm portion extending transversely from the base, configured to contact one of the first panel side walls defining the edge channel, and defining the slot, said slot accommodating adjoining lips of the reversibly joined first and second panels.

3. The first connector of claim 2, in which the base defines a plurality of ribs extending from the base.

4. The first connector of claim 2, the base further comprising a contact element operably proximate the arm portion.

5. The first connector of claim 4, the arm portion further comprising a ledge, the biasing element extending from the ledge, the biasing element being biased toward the ledge when the first and second connectors are joined.

6. The first connector of claim 5, in which said first and second seating surfaces are disposed on the biasing element.

7. The first connector of claim 5, in which the first seating surface is generally centrally disposed an the ledge and the second seating surface is generally centrally disposed on the biasing element.

8. The first connector of claim 5, in which a first end of the biasing element extends from the ledge.

9. The first connector of claim 5, in which first and second ends of the biasing element extend from the ledge.

10. The first connector of claim 5, which the biasing element includes a generally arcuate contacting surface.

11. A display system, comprising:

first and second panels, each panel including two side walls, a cross-wall, and side wall extensions extending outside the cross-wall, the cross-wall separating the side walls, each side wall extension terminating in a lip, the side wall extensions, the lips and the cross-wall cooperating to define an edge channel; and a first connector positioned in the first panel edge channel and a second connector positioned in the second panel edge channel, each connector defining a slot accommodating one of the lips and comprising a base attaching to the cross-wall of the panel, a resilient biasing element and first and second seating surfaces in operative relation to the biasing element, the first seating surface at least partially conforming to the second scaling surface the first and second seating surfaces facing toward and spaced apart from the base, the biasing element extending from the first seating surface toward the base, the first and second panels reversibly connectable by reversibly mating the first and second connectors, the first and second connectors reversibly mated by vertically aligning the first and second connector biasing elements, then displacing the first connector to bias the first and second connector biasing elements away from the respective first and second cross-walls and seating the second seating surfaces in the first seating surfaces.

12. A method of reversibly connecting first and second display panels, each display panel including a pair of sidewalls, a cross-wall extending between the sidewalls, and sidewall extension extending outside the cross-wall, each sidewall extension terminating in a lip, the cross-wall, sidewall extensions and lips defining an edge channel, first and second connectors being disposed in respective first and second edge channels, each connector including a generally axial slot accommodating adjacent lips of joined panels and comprising a base attached to the first and second panel cross-walls, a member extending generally transversely from the base and including a ledge, a resilient biasing element extending from the ledge, and first and second seating surfaces in operative relation to the biasing element, the first seating surface at least partially conforming to the second seating surface, the method comprising:

aligning the biasing elements and seating surfaces of the first and second connectors; and slidably mating the first and second connectors by biasing the first biasing element against the second connector, biasing the second biasing element against the first connector, seating the first connector first seating surface and the second connector second seating surface, and seating the first connector second seating surface and the second connector first seating surface.

13. The method of claim 12, in which the biasing elements and seating surfaces are vertically aligned.

14. The method of claim 12, in which the biasing elements and seating surfaces are aligned by contacting an edge of the first panel to an edge of the second panel when the first panel is in a raised position.

15. The method of claim 12, which the first seating surface generally centrally extends from the ledge and the second sealing surface is generally centrally disposed in the biasing element, the first seating surface being at least partially disposed in the second seating surface when the first and second connectors are slidably mated.

16. A panel system comprising a plurality of rectangular panels and a plurality of connectors fixed to said panels, each panel comprising a pair of horizontal edges and a pair of vertical edges, at least one of said edges having a channel therein, the channel having a channel base with a pair of channel side walls, at least one of said connectors fixed in said channel, each connector comprising a base portion and a grasping arm portion, the base portion secured to the channel base and the grasping arm portion extending outwardly out of the channel, the arm portion having an integral arcuate spring member having an inwardly facing seating surface and a cantilevered portion having an inwardly facing seating surface, each connector configured to cooperatively connect with another like cooperating connector in an adjoining panel thereby securing the panels together in planar arrangement, the inwardly facing seating surface of each cantilevered portion positioned to engage the seating surface of the integral arcuate spring member of the cooperating connector and the spring of each connector being biased toward the cantilevered portion.

17. The panel system of claim 16 wherein the connectors are each injected molded and comprised of polycarbonate.

18. The panel system of claim 17 wherein each connector is further comprised of polytetrafluoroethylene.

19. An integral plastic connector for attachment to a panel edge of a first panel for securing said panel to the panel edge of a second panel to form a fill bleed display surface, the connector comprising a base portion and a grasping arm portion extending outwardly therefrom, the grasping arm portion having a integral spring portion formed by an aperture in the arm portion and a protruding portion, the spring portion displaced from the base portion and forming a gap therebetween, the spring portion and protruding portion configured such that the connector on a first panel is engagable with a cooperative like connector on the second panel whereby each protruding portion of each connector is engaged with the spring portion of the other connector and wherein the protruding portion of each connector is captured in the gap of the other connector.

20. The connector of claim 19 wherein the connector comprises of a fluoropolymer.

21. An integral plastic connector for affixing to a panel edge of a first panel for securing said panel to the panel edge of a second panel to form a full bleed display surface, the panel edge having a channel with a base and a pair of side walls, each side wall having a inwardly extending lip, the connector comprising a base portion and a grasping arm portion extending outwardly therefrom, the grasping arm portion having a cantilevered portion, a spring extending from the cantilevered portion, toward the base portion, the cantilevered portion defining a seating surface extending outwardly form the spring, the grasping arm portion configured to contact one of the two side walls and extend out of said channel, the grasping arm having a slot for receiving the lip of said sidewall of the panel that said connector is attached to and also for receiving the lip of the sidewall of the second panel thereby securing the two panels together as the spring is biased toward the cantilevered portion.

* * * * *

UNITED STATES PATENT AND TRADEMARK OFFICE

CERTIFICATE OF CORRECTION

PATENT NO. : 6,854,234 B2 
DATED : February 15, 2005
INVENTOR(S) : Dixon Gimpel, Timothy Cota and William Funk It is certified that error appears in the above-identified patent and that said Letters Patent is hereby corrected as shown below:

Column 2,
Line 12, please insert -- . -- after "together".

Column 3,
Lines 10 and 26, please delete "Wittier" and insert -- Wittler --.

Column 6,
Line 34, please delete "120," and insert -- 120 --.
Line 35, please delete "ups" and insert -- lips --.

Column 9,
Line 7, please delete "2 12" and insert -- 212 --.

Column 11,
Line 3, please insert -- in -- after "5,".
Line 20, please delete "scaling" and insert -- seating --.
Line 35, please delete "extension" and insert -- extensions --.
Line 63, please insert -- in -- after "12,".

Column 12,
Line 1, please delete "sealing" and insert -- seating --.
Line 56, please delete "form" and insert -- from --.

Signed and Sealed this

Thirtieth Day of August, 2005

JON W. DUDAS
*Director of the United States Patent and Trademark Office*